US010321719B2

(12) United States Patent
Peuchert et al.

(10) Patent No.: US 10,321,719 B2
(45) Date of Patent: Jun. 18, 2019

(54) HEATING ELEMENTS FOR ELECTRONIC CIGARETTES

(71) Applicant: SCHOTT AG, Mainz (DE)

(72) Inventors: Ulrich Peuchert, Bodenheim (DE); Fritz Wintersteller, Teisendorf (DE); Michael Kluge, Offenbach (DE)

(73) Assignee: SCHOTT AG, Mainz (DE)

( * ) Notice: Subject to any disclaimer, the term of this patent is extended or adjusted under 35 U.S.C. 154(b) by 3 days.

(21) Appl. No.: 15/682,877

(22) Filed: Aug. 22, 2017

(65) Prior Publication Data

US 2018/0064170 A1 Mar. 8, 2018

(30) Foreign Application Priority Data

Aug. 23, 2016 (DE) ..... 10 2016 115 574

(51) Int. Cl.

| | |
|---|---|
| ***A24F 13/00*** | (2006.01) |
| ***A24F 47/00*** | (2006.01) |
| ***H05B 3/08*** | (2006.01) |
| ***H05B 3/26*** | (2006.01) |
| ***H05B 3/46*** | (2006.01) |

(52) U.S. Cl.

CPC ..... *A24F 47/008* (2013.01); *H05B 3/08* (2013.01); *H05B 3/265* (2013.01); *H05B 3/46* (2013.01); *H05B 2203/003* (2013.01); *H05B 2203/013* (2013.01); *H05B 2203/021* (2013.01)

(58) Field of Classification Search

CPC ..... A24F 47/002; A24F 47/008; H05B 3/08
USPC ..... 131/329, 328
See application file for complete search history.

(56) References Cited

U.S. PATENT DOCUMENTS

| | | | | |
|---|---|---|---|---|
| 5,878,752 | A * | 3/1999 | Adams | A24F 47/008 131/194 |
| 9,572,373 | B2 * | 2/2017 | Chen | A24F 47/008 |
| 9,986,767 | B2 * | 6/2018 | Batista | A24F 47/008 |
| 2005/0172976 | A1 | 8/2005 | Newman | |
| 2008/0023003 | A1 | 1/2008 | Rosenthal | |
| 2008/0083744 | A1 | 4/2008 | Ruiz | |
| 2014/0060554 | A1 * | 3/2014 | Collett | H05B 3/265 131/328 |
| 2014/0305448 | A1 | 10/2014 | Zuber | |
| 2015/0163859 | A1 * | 6/2015 | Schneider | A24F 47/008 131/329 |
| 2015/0181943 | A1 * | 7/2015 | Li | H05B 3/48 131/329 |
| 2016/0021931 | A1 | 1/2016 | Hawes | |

(Continued)

FOREIGN PATENT DOCUMENTS

| | | |
|---|---|---|
| DE | 202013100606 | 2/2013 |
| DE | 102012212351 | 1/2014 |

(Continued)

*Primary Examiner* — Hae Moon Hyeon
(74) *Attorney, Agent, or Firm* — Ohlandt, Greeley, Ruggiero & Perle, L.L.P.

(57) ABSTRACT

A heating element is provided that configured for use in an electronic cigarette. The heating element includes at least one carrier material made of glass or glass ceramic and metallic heating conductor structures. The heating conductor structures are on the carrier material and the carrier material has a thermal conductivity of less than 2 W/K*m, a thermal capacity of less than 1000 J/K*kg, and a roughness $R_a$ of less than 500 nm.

25 Claims, 3 Drawing Sheets

(56) References Cited

U.S. PATENT DOCUMENTS

| | | | | |
|---|---|---|---|---|
| 2016/0135505 | A1* | 5/2016 | Li | H05B 3/44 131/329 |
| 2017/0055581 | A1* | 3/2017 | Wilke | H05B 6/10 |
| 2017/0079332 | A1* | 3/2017 | Li | A24F 47/008 |
| 2017/0105454 | A1* | 4/2017 | Li | H05B 1/0244 |
| 2017/0215481 | A1* | 8/2017 | Li | H05B 3/42 |
| 2017/0238609 | A1* | 8/2017 | Schlipf | H05B 3/04 |
| 2017/0340016 | A1* | 11/2017 | Thorens | A24F 47/008 |
| 2018/0007972 | A1* | 1/2018 | Thorens | A61M 11/003 |

FOREIGN PATENT DOCUMENTS

| | | |
|---|---|---|
| EP | 2316286 | 5/2011 |
| EP | 2469969 | 6/2012 |
| EP | 2921065 | 9/2015 |
| EP | 2921066 | 9/2015 |
| WO | 2011050964 | 5/2011 |
| WO | 2014102092 | 7/2014 |

* cited by examiner

HEATING ELEMENTS FOR ELECTRONIC CIGARETTES

CROSS REFERENCE TO RELATED APPLICATIONS

This application claims benefit under 35 U.S.C. § 119(a) of German Patent Application No. 10 2016 115 574.8 filed Aug. 23, 2016, the entire contents of which are incorporated herein by reference.

BACKGROUND OF THE INVENTION

1. Field of the Invention

The invention generally relates to a heating element for hot applications. More particularly, the invention relates to a heating element for heating and evaporating in controlled manner vaporizable and/or tobacco-containing substances in electronic cigarettes.

2. Description of Related Art

Electronic cigarettes, also referred to as e-cigarettes below, are increasingly used as an alternative to tobacco cigarettes. Typically, e-cigarettes have a mouthpiece and an evaporator unit that comprises a heating element.

The heating element heats a vaporizable liquid so that the latter can be inhaled by the user. This liquid may already contain nicotine. Alternatively, the liquid is free of nicotine. In this case, the aerosol that is being formed may then flow through a nicotine containing and nicotine releasing body.

For example, lance-shaped heating elements are known from the prior art. These heating elements are introduced into a specially designed piece of tobacco and thus brought into contact with the substances to be evaporated to heat them to temperatures ranging from 50° C. to 350° C. This causes formation of an aerosol. Such heating lances may consist of a heating wire without a carrier material. However, a drawback hereof is that because of the required mechanical stability of the heating element the dimensions of the heating element cannot be made arbitrarily small. Furthermore, such heating elements tend to become easily contaminated during use.

Therefore, as an alternative, heating lances are described in the prior art which have heating conductor structures that are applied on a carrier material. These heating lances have ceramic carrier materials, since in addition to high temperature stability the latter provide electrical insulation. For example, EP 2 469 969 describes heating lances with carrier materials based on $ZrO_2$ ceramics.

A drawback when employing ceramic carrier materials, however, is not only their high manufacturing costs, but also their high surface roughness and porosity. Roughness and porosity have an adverse effect on the heating conductor structures applied thereon in the form of a conductive coating. For example, the rough surface adversely affects the adhesion of the conductive coating to the carrier material.

Furthermore, the known ceramic carrier materials exhibit high thermal conductivity. This is unfavorable for the use in a heating element, since the heat generated in the heated portion of the heating element cannot be released into the medium to be heated in controlled manner, rather heat dissipation through the ceramic will occur and the heat dissipated in this manner will therefore no longer be available for the evaporation or heating of the substances. Accordingly, more heating power has to be provided by the heating element, which not only adversely affects the energy consumption and therefore the battery or recharge time of the e-cigarette, for example, but may also lead to a temperature increase in the e-cigarette and thus may have an adverse effect on the service life of the heating element.

In an alternative configuration of an e-cigarette, the heating element can be arranged within the e-cigarette so as to be not directly introduced into the piece of tobacco or the substances to be evaporated, but rather so as to enclose the piece of tobacco or a reservoir with the substances to be evaporated in cylindrical manner. Such an arrangement is described in US 2005/0172976, for example. Such external heating elements offer the advantage that the substances or tobacco pieces to be evaporated can be exchanged more easily. Due to the desired small dimensions of the e-cigarettes, which are typically modeled on the dimensions of conventional tobacco cigarettes, very small diameters and thus bending radii are resulting with such an arrangement of the heating element. Since, moreover, the carrier material has to be an electrical insulator, only high-performance plastics such as, for example, polyimides or polyamides have so far been used as the carrier material.

In such arrangements, performance and service life of the heating element is limited by the rather low temperature resistance of the plastics. Moreover, leaching effects may be caused by the organic solvents used in the e-cigarette. On the one hand, this is disadvantageous with regard to the service life of the heating element. In addition, constituents of the carrier material might be dissolved in the organic solvent and inhaled by the user.

SUMMARY

It is therefore an object of the invention to provide a heating element, in particular a heating element to be used in e-cigarettes, which provides excellent heating performance and a long service life and which moreover can be used in a variety of e-cigarettes of different configurations.

The heating element of the invention is particularly suitable to be used in an e-cigarette and comprises at least one carrier material made of glass or glass ceramic, and metallic heating conductor structures.

The glass or glass ceramic carrier material exhibits high temperature stability of more than 300° C. or even more than 400° C. This is for instance achieved by using glasses with a high glass transition temperature $T_g$.

At the same time, the carrier material has a very low thermal conductivity of less than 2 W/(K*m). The low thermal conductivity and the low heat capacity of the carrier material reduce or prevent propagation of the heat generated by the heating element within the carrier material, and therefore provide for controlled heat conduction from the heating element into the substances to be evaporated. According to an advantageous embodiment of the invention, the carrier material has a thermal conductivity of <1.8 W/(K*m) or even <1.5 W/(K*m).

At the same time, the specific heat capacity of the carrier material is less than 1200 J/K*kg, preferably even less than 1000 J/K*kg. The low heat capacity ensures that the heat generated in the heating element is passed quickly and the most completely possible to the substances to be evaporated. This is advantageous with regard to the energy requirement in the evaporation process. At the same time, excessive heating of the heating element is avoided in this way, which has an advantageous effect on the service life thereof.

Thus, preferably, both a low thermal conductivity and low thermal capacity of the carrier material are required in order to achieve good heating performance of the heating element. Therefore, according to a further embodiment of the invention the heating element has a figure of merits (FOM) for the product of thermal conductivity and heat capacity, FOM =thermal conductivity*specific heat capacity, of less than 1800 $J^2/K^2*m*s*kg$ or even less than 1500 $J^2/K^2*m*s*kg$, more preferably even less than 1200 $J^2/K^2*m*s*kg$, most preferably even less than 1000 $J^2/K^2*m*s*kg$ at exemplary temperatures of 20- 100° C. In contrast to the carrier material of the invention, the ceramics previously described as carrier materials in the prior art have higher thermal conductivities and heat capacities. For example, $Al_2O_3$ ceramics exhibit thermal conductivities of 20 to 30 W/K*m, which is higher than in the case of the carrier materials of the invention by a factor of 20. $ZrO_2$ ceramics, with 2 - 3 W/K*m, have values that are still higher by at least a factor of 1.5 compared to glass.

The carrier material ensures mechanical stability of the heating element. Metallic heating conductor structures are applied to a or to the surface of the carrier material and may be applied on the carrier material in the form of a coating, for example. Since the carrier material of the invention has a very smooth surface, with a roughness $R_a$ of less than 500 nm or even less than 250 nm, most preferably even less than 20 nm, it is possible to achieve particularly good adhesion between the carrier material and the metallic heating conductor structures, which translates into high mechanical resistance of the heating element, for example.

Due to the high mechanical strength of the employed carrier material, the latter can be formed with an appropriately small thickness. This allows for a particularly compact structure of the heating element and the entire e-cigarette.

During the manufacturing of the heating elements of the invention, the glass (or the corresponding green glass, if glass ceramics are used as the carrier material) can be brought into the desired shape or geometry by drawing processes. In addition to a flexible adaptation of the carrier material to the respective configuration of the e-cigarette, this moreover provides for a cost-effective production of the heating elements.

According to one embodiment of the invention, the carrier material is in the form of a tube or rod having a diameter of less than 20 mm. The tube or the rod may have a circular, ellipsoidal, triangular or polygonal cross-sectional shape. The carrier material may as well be in the form of a hollow glass profile. The corresponding glass tubes or rods can be obtained by drawing processes. According to one implementation of the embodiment, the glass tubes have a wall thickness of less than 5 mm.

According to a further embodiment of the invention, the glass of the carrier material is a thin or ultra-thin glass having a thickness of less than 2000 μm, less than 1000 μm or even less than 500 μm. The carrier material may be a sheet glass in this case. It is even possible to use thin glasses as the carrier material, which have a thickness of less than 100 μm or even less than 50 μm.

According to one implementation of this embodiment, the thin glass is transformed into a glass roll having a diameter of less than 20 mm. This may be accomplished, for example, by rolling up the relevant sheet glass. In this case it is even possible to obtain carrier materials in the form of thin glass rolls with a diameter of less than 10 mm.

In particular silicate glasses, borosilicate glasses, aluminum silicate glasses, or aluminum borosilicate glasses have been found to be suitable glasses to be used as the carrier material. Glass ceramics produced therefrom by temperature treatment can also be used.

According to one embodiment of the invention, the carrier material is a glass with the following constituents (in wt %):

| | |
|---|---|
| $SiO_2$ | 50 to 66 |
| $B_2O_3$ | 0 to 7 |
| $Al_2O_3$ | 10 to 25 |
| MgO | 0 to 7 |
| CaO | 5 to 16 |
| SrO | 0 to 8 |
| BaO | 6 to 18 |
| $P_2O_3$ | 0 to 2 |
| $ZrO_2$ | 0 to 3 |
| $TiO_2$ | 0 to 5. |

Glasses with the following constituents (in wt %) have been found to be particularly advantageous in this case:

| | |
|---|---|
| $SiO_2$ | 52 to 64 |
| $B_2O_3$ | 0 to 5.5 |
| $Al_2O_3$ | 12 to 18 |
| MgO | 0 to 5 |
| CaO | 9 to 14.5 |
| SrO | 0 to 4 |
| BaO | 8 to 12 |
| $P_2O_3$ | 0 to 1 |
| $ZrO_2$ | 0 to 2 |
| $TiO_2$ | 0 to 3. |

Silicate glasses that can be used also include borosilicate glasses such as Zn—Ti borosilicate glasses, Zn silicate glasses, and also sodium silicate glasses with a high $SiO_2$ content.

According to a further embodiment of the invention, alkali-containing borosilicate glasses with the following constituents (in wt %) are used as the carrier glass:

| | |
|---|---|
| $SiO_2$ | 70 to 85 |
| $B_2O_3$ | 0 to 15 |
| $Al_2O_3$ | 1 to 10 |
| $Na_2O$ | 1 to 10 |
| $K_2O$ | 0 to 5 |
| CaO | 0 to 5, preferably ≥0.1. |

In a further embodiment of the invention, the glass contains the following constituents (data in mol %):

| | |
|---|---|
| $SiO_2$ | 64 to 78 |
| $Al_2O_3$ | 5 to 14 |
| $Na_2O$ | 4 to 12 |
| $K_2O$ | 0 to 5 |
| MgO | 0 to 14 |
| CaO | 1 to 12 |
| $ZrO_2$ | 0 to 2 |
| $TiO_2$ | 0 to 4.5, with $Al_2O_3/Na_2O$ ≥1 mol %, and $\Sigma SiO_2 + Al_2O_3$ ≤82 mol %. |

In a further embodiment of the invention, the glass contains the following constituents (data in wt %):

| | |
|---|---|
| $SiO_2$ | 58 to 65 |
| $B_2O_3$ | 6 to 10.5 |
| $Al_2O_3$ | 14 to 25 |
| MgO | 0 to 5 |
| CaO | 0 to 9 |
| BaO | 0 to 8, preferably 3 to 8 |
| SrO | 0 to 8 |
| ZnO | 0 to 2. |

In a further embodiment of the invention, the glass contains the following constituents (data in wt %):

| | |
|---|---|
| $SiO_2$ | 50 to 65 |
| $Al_2O_3$ | 15 to 20 |
| $B_2O_3$ | 0 to 6 |
| $Li_2O$ | 0 to 6 |
| $Na_2O$ | 8 to 15 |
| $K_2O$ | 0 to 5 |
| MgO | 0 to 5 |
| CaO | 0 to 7, preferably 0 to 1 |
| ZnO | 0 to 4, preferably 0 to 1 |
| $ZrO_2$ | 0 to 4 |
| $TiO_2$ | 0 to 1, preferably substantially free of $TiO_2$. |

In a further embodiment of the invention, the glass contains the following constituents (data in wt %):

| | |
|---|---|
| $SiO_2$ | 30 to 85 |
| $B_2O_3$ | 3 to 20 |
| $Al_2O_3$ | 0 to 15 |
| $Na_2O$ | 3 to 15 |
| $K_2O$ | 3 to 15 |
| ZnO | 0 to 12 |
| $TiO_2$ | 0.5 to 10 |
| CaO | 0 to 0.1. |

In a further embodiment of the invention, the glass contains the following constituents (data in wt %):

| | |
|---|---|
| $SiO_2$ | 55 to 75 |
| $Na_2O$ | 0 to 15 |
| $K_2O$ | 2 to 14 |
| $Al_2O_3$ | 0 to 15 |
| MgO | 0 to 4 |
| CaO | 3 to 12 |
| BaO | 0 to 15 |
| ZnO | 0 to 5 |
| $TiO_2$ | 0 to 2. |

In a further embodiment of the invention, the glass contains the following constituents (data in wt %):

| | |
|---|---|
| $SiO_2$ | 50 to 70 |
| $Na_2O$ | 0 to 5 |
| $K_2O$ | 0 to 5 |
| $Al_2O_3$ | 17 to 27 |
| MgO | 0 to 5 |
| BaO | 0 to 5 |
| SrO | 0 to 5 |
| ZnO | 0 to 5 |
| $TiO_2$ | 0 to 5 |
| $ZrO_2$ | 0 to 5 |
| $Ta_2O_5$ | 0 to 8 |
| $P_2O_5$ | 0 to 10 |
| $Fe_2O_3$ | 0 to 5 |
| $CeO_2$ | 0 to 5 |
| $Bi_2O_3$ | 0 to 3 |
| $WO_3$ | 0 to 3 |
| $MoO_3$ | 0 to 3, and |
| | common refining agents, e.g. $SnO_2$, $SO_4$, Cl, $As_2O_3$, $Sb_2O_3$ in amounts from 0 to 4 wt %. |

In a further embodiment of the invention, the glass contains the following constituents (data in wt %):

| | |
|---|---|
| $SiO_2$ | 35 to 70, preferably 35 to 60 |
| $Al_2O_3$ | 14 to 40, preferably 16.5 to 40 |
| MgO | 0 to 20, preferably 4 to 20, more preferably 6 to 20 |
| BaO | 0 to 10, preferably 0 to 8 |
| SrO | 0 to 5, preferably 0 to 4 |
| ZnO | 0 to 15, preferably 0 to 9, more preferably 0 to 4 |

-continued

| | |
|---|---|
| $TiO_2$ | 0 to 10, preferably 1 to 10 |
| $ZrO_2$ | 0 to 10, preferably 1 to 10 |
| $Ta_2O_5$ | 0 to 8, preferably 0 to 2 |
| $B_2O_3$ | 0 to 10, preferably >4 to 10 |
| CaO | 0 to <8, preferably 0 to 5, more preferably <0.1 |
| $P_2O_5$ | 0 to 10, preferably <4 |
| $Fe_2O_3$ | 0 to 5 |
| $CeO_2$ | 0 to 5 |
| $Bi_2O_3$ | 0 to 3 |
| $WO_3$ | 0 to 3 |
| $MoO_3$ | 0 to 3, and |
| | common refining agents, e.g. $SnO_2$, $SO_4$, Cl, $As_2O_3$, $Sb_2O_3$ in amounts from 0 to 4 wt %. |

In particular alkali-containing aluminosilicate glasses can be chemically toughened through ion exchange, and the mechanical stability of the carrier material can be further increased in this way. In particular fracture probability can be significantly reduced. Because of the high glass transition temperature $T_g$ of the glasses of more than 600° C., the ion exchange can take place at temperatures above 400° C., so that only a short ion exchange time is required. Therefore, according to a further embodiment of the invention the carrier material is a chemically toughened glass.

This is particularly advantageous in the case of carrier materials based on thin or ultra-thin glasses. For example, flat or ultra-flat carrier components having a thickness ranging from 0.1 to 0.5 mm can be obtained through a down-draw or overflow fusion process and can be chemically toughened without prior further thinning.

Alternatively or additionally, the mechanical strength of the carrier component can be further increased by chemical and/or mechanical edge processing such as contouring or etching of the edge, for example. According to a further embodiment of the invention it is therefore contemplated that the edges of the carrier component have been processed chemically and/or mechanically. This is particularly advantageous for heating elements comprising carrier components made of alkali-free glasses, since in this case the mechanical strength cannot be increased by ion exchange. The use of alkali-free glasses, for example of alkali-free aluminoborosilicate glasses as the carrier material is particularly advantageous because of the high chemical resistance and good processability thereof, in particular the possibility to draw the relevant glasses into ultra-thin shapes.

According to a further embodiment of the invention, a glass ceramic is used as the carrier component, preferably an LAS glass ceramic (lithium aluminosilicate glass ceramic) or MAS glass ceramic (magnesium aluminosilicate glass ceramic). For example, LAS glass ceramics have very low values of thermal conductivity of 1.1 W/K*m, which has an advantageous effect on heating performance. At the same time, glass ceramics exhibit high mechanical stability.

The heating conductor structures may be applied in a helical or meandering shape on the surface of the carrier material, for example. A further embodiment of the invention contemplates an application of the heating conductor structures over the entire surface of the carrier material.

In the case of a tubular carrier material, the heating conductor structures may be applied on the inner or on the outer lateral surface of the carrier material, depending on the design of the heating element or of the corresponding e-cigarette.

According to one embodiment of the invention, the heating conductor structures are applied on the surface of the carrier material in the form of an electrically conductive coating, preferably as a platinum-containing coating or an indium tin oxide (ITO) coating.

BRIEF DESCRIPTION OF THE DRAWINGS

The invention will now be explained in more detail with reference to exemplary embodiments and to FIGS. 1 to 5, wherein.

DETAILED DESCRIPTION

Figure 1:
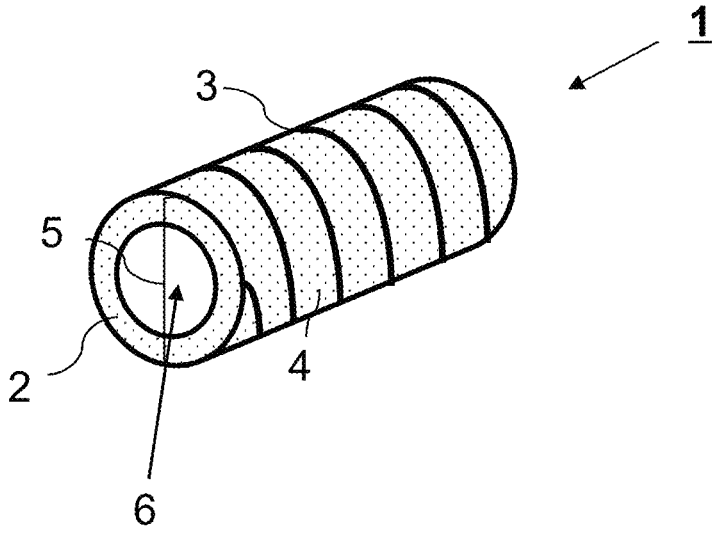
FIG. 1 schematically illustrates an exemplary embodiment of a heating element according to the invention, in which the carrier material has a tubular shape and the heating conductor structures are arranged on the outer lateral surface of the tube.

TABLES 1 to 4 show 13 different exemplary embodiments for the employed carrier material. The individual exemplary embodiments differ in the composition of the glass. Examples 1 to 5 listed in TABLE 1 contain alkali ions and can be chemically toughened. Examples 6 and 7 listed in TABLE 2 are alkali-free glasses. In this case, a further increase in mechanical strength may be accomplished by chemical and/or mechanical edge processing, for example.

TABLE 1

Alkali-containing exemplary embodiments

| Component | Example 1 wt % | Example 2 wt % | Example 3 wt % | Example 4 mol % | Example 5 mol % |
|---|---|---|---|---|---|
| $SiO_2$ | 81 | 79 | 75 | 68.5 | 68.2 |
| $B_2O_3$ | 12.7 | 10 | 10 | | |
| $Al_2O_3$ | 2.4 | 4 | 6 | 12 | 11.8 |
| $Na_2O$ | 3.5 | 5 | 7 | 12 | 10.5 |
| $K_2O$ | 0.6 | 1 | 0 | 0.5 | 0 |
| MgO | | | | | 1.2 |
| CaO | 0 | 1 | 1.5 | 5 | 5.2 |
| $TiO_2$ | | | | 1.5 | 3.1 |
| $ZrO_2$ | | | | 0.5 | 0 |
| $\alpha_{20\text{-}300}$ [ppm/K] | $3.3 * 10^{-6}$ | $4 * 10^{-6}$ | $4.9 * 10^{-6}$ | $7.6 * 10^{-6}$ | $6.8 * 10^{-6}$ |
| Tg [° C.] | 525 | 555 | 565 | 642 | 685 |
| Density [g/cm$^3$] | 2.2 | 2.3 | 2.34 | 2.46 | 2.47 |
| Thermal conductivity @ 90° C. [W/mK] | 1.3 | 1.1 | 1.2 | 1.0 | 1.0 |
| Mean specific thermal capacity Cp at 20-100° C. [J/(K * g)] | 0.82 | | | | |

TABLE 2

Alkali-free exemplary embodiments

| Component | Example 6 [wt %] | Example 7 [wt %] |
|---|---|---|
| $SiO_2$ | 60 | 61 |
| $B_2O_3$ | 4.5 | 0.5 |
| $Al_2O_3$ | 14 | 16.2 |
| MgO | 2.5 | |
| CaO | 10 | 13 |
| BaO | 9 | 8 |
| $ZrO_2$ | | 1 |
| $\alpha_{20\text{-}300}$ [ppm/K] | $4.6 * 10^{-6}$ | $4.7 * 10^{-6}$ |
| Tg [° C.] | 720 | 790 |
| Density [g/cm$^3$] | 2.63 | 2.67 |
| Thermal conductivity @ 90° C. [W/mK] | 1.1 | 1.1 |

TABLE 3

Exemplary embodiments 8 to 11

| Component | Example 8 wt % | Example 9 wt % | Example 10 wt % | Example 11 wt % |
|---|---|---|---|---|
| $SiO_2$ | 61 | 60.7 | 64.0 | 64-74 |
| $B_2O_3$ | 10 | | 8.3 | |
| $Al_2O_3$ | 18 | 16.9 | 4.0 | |

TABLE 3-continued

| Exemplary embodiments 8 to 11 | | | | |
|---|---|---|---|---|
| Component | Example 8 wt % | Example 9 wt % | Example 10 wt % | Example 11 wt % |
| $Na_2O$ | | 12.2 | 6.5 | 6-10 |
| $K_2O$ | | 4.1 | 7.0 | 6-10 |
| MgO | 2.8 | 3.9 | | |
| CaO | 4.8 | | | 5-9 |
| BaO | 3.3 | | | 0-4 |
| $ZrO_2$ | | 1.5 | | |
| $SnO_2$ | | 0.4 | | |
| $CeO_2$ | | 0.3 | | |
| ZnO | | | 5.5 | 2-6 |
| $TiO_2$ | | | 4.0 | 0-2 |
| $Sb_2O_3$ | | | 0.6 | |
| Cl | | | 0.1 | |
| $\alpha_{20\text{-}300}$ [ppm/K] | $3.2 \cdot 10^{-6}$ | | $7.2 \cdot 10^{-6}$ | $9.4 \cdot 10^{-6}$ |
| Tg [° C.] | 717 | | 557 | 553 |
| Density [g/cm$^3$] | 2.43 | | 2.5 | 2.55 |
| Thermal conductivity @ 90° C. [W/mK] | 1.16 | | | |
| Mean specific thermal capacity Cp at 20-100° C. [J/(K * g)] | 0.8 | | | |

TABLE 4

| Exemplary alkali-containing glass ceramic compositions | | |
|---|---|---|
| Component | Example 12 wt % | Example 13 wt % |
| $SiO_2$ | 65.45 | 64.45 |
| $Al_2O_3$ | 21.97 | 21.97 |
| $Na_2O$ | 0.51 | 0.51 |
| $Li_2O$ | 3.72 | 3.72 |
| MgO | 0.47 | 0.47 |
| BaO | 2.02 | 2.02 |
| ZnO | 1.7 | 1.7 |
| $TiO_2$ | 2.39 | 3.4 |
| $ZrO_2$ | 1.76 | 1.76 |
| $\alpha_{20\text{-}300}$ [ppm/K] | $4.0 * 10^{-6}$ | $4.05 * 10^{-6}$ |
| Tg [° C.] | 690 | 685 |
| Thermal conductivity @ 90° C. [W/mK] | 1.1 | 1.1 |
| Mean specific thermal capacity Cp at 20-100° C. [J/(K * g)] | 0.80 | 0.81 |

TABLE 4 shows exemplary starting glass compositions from the LAS glass ceramic system. In the ceramized state, the expansion coefficients are in a range of 0±0.5 ppm/K. Thermal conductivity is 1.7 W/mK.

FIG. 1 schematically illustrates an exemplary embodiment of a heating element 1 according to the invention, in which the carrier material 2 has a tubular design. In this exemplary embodiment, the heating conductor structures 3 are located on the outer lateral surface 4 of the carrier material 2 and are arranged in helical manner. The carrier material 2 has a diameter 5 of less than 20 mm, the carrier material has a wall thickness of less than 5 mm. Because of the cavity 6, the heating element 1 is suitable to be used as an externally engaging cylindrical heating element for so-called heat-not-burn cigarettes, for example.

The configuration of the heating element 1 shown in FIG. 1 may as well be realized with an ultra-thin glass as the carrier material. For example, an appropriate ultra-thin glass such as an alkali aluminosilicate glass may initially be provided as a sheet glass. In a subsequent manufacturing step, the glass may be provided with heating conductor structures 3 and rolled up into a tube.

Figure 2:
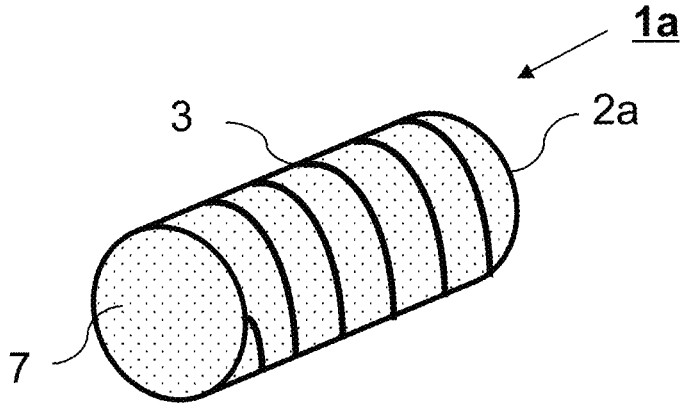
FIG. 2 schematically illustrates an exemplary embodiment of a heating element according to the invention, in which the carrier material is of rod-shaped design.

FIG. 2 schematically illustrates a further embodiment of a heating element 1*a*. According to this embodiment, the carrier material 2*a* is in the form of a glass or glass ceramic rod having a diameter of less than 20 mm. The heating conductor structures 3 are applied as a helical coating on the surface of the carrier material 2*a*. The ends 7 of the carrier material 2*a* are flat in the embodiment shown here. However, depending on the requirements on the design of the heating element, the carrier material 2*a* may as well have rounded or pointed ends. A different geometrical shape of the two ends of the carrier material 2*a* is also possible.

Figure 3:
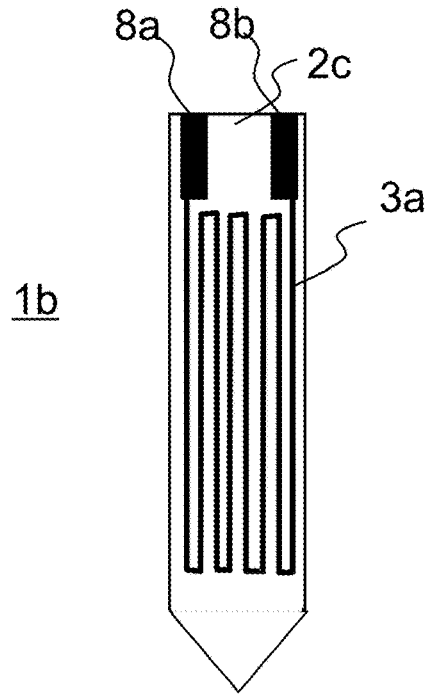
FIG. 3 schematically illustrates a further exemplary embodiment in which the carrier material is in the form of a sheet glass and has meandering heating conductor structures thereon.

FIG. 3 schematically illustrates a further exemplary embodiment of a heating element 1*b*, in which the carrier material 2*c* is in the form of a sheet glass and has meandering heating conductor structures 3*a* thereon. The carrier material is shaped with a tip at one end thereof. This makes it possible to introduce the heating element shown in FIG. 3 into a piece of tobacco, for example.

Heating conductor structures 3*a* can be connected to a power source (not shown) through contacts 8*a* and 8*b*. The embodiment illustrated in FIG. 3 may as well be realized using ultra-thin sheet glasses as the carrier material 2*c*. In this case, glass thicknesses of less than 100 μm or even less than 50 μm are possible.

Figure 4:
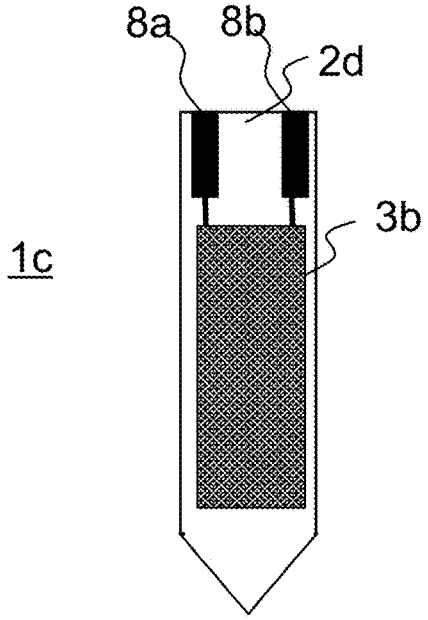
FIG. 4 schematically illustrates a further exemplary embodiment in which the carrier material is in the form of a sheet glass with heating conductor structures over the entire surface thereof.

FIG. 4 schematically illustrates a further exemplary embodiment of a heating element 1*c* in which the carrier material 2*d* is in the form of a sheet glass and has heating conductor structures 3*b* over the entire surface thereof. The carrier material is shaped with a tip at one end thereof. This makes it possible to introduce the heating element shown in FIG. 4 into a piece of tobacco, for example.

Figure 5:
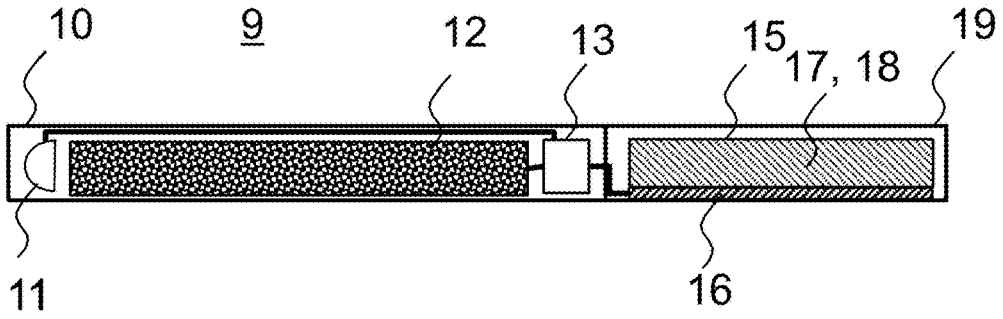
FIG. 5 schematically illustrates the configuration of an electronic cigarette.

FIG. 5 illustrates an electronic cigarette 9. Cigarette 9 has a front portion 10 and a mouthpiece 19 on which the user draws to inhale the aerosol generated in the cigarette by means of an evaporator 15. According to a preferred embodiment of the invention, the mouthpiece 19 is detachable from the tip 10.

Cigarette 9 includes an electric energy storage 12 to provide the electric power for vaporizing the organic liquid in the evaporator 15. In the illustrated embodiment, the electric energy storage 12 is accommodated in the front portion 10 of cigarette 9.

Furthermore, the electronic cigarette 9 includes a control unit 13 which controls the heating power of the heating element in the evaporator 15. Control unit 13 may in particular be adapted to determine whether a user is inhaling, and depending thereon to control the heating power of the heating element 16.

Furthermore, a light emitting diode 11 may be arranged in the front portion 10, which is likewise controlled by control unit 13. When the control unit 13 determines that the user draws on his cigarette 9, the control unit can control the light emitting diode 11 so that the light emitting diode 11 emits light. In this manner, a visual effect is obtained which corresponds to the glowing when drawing on a conventional cigarette.

The evaporator unit 15 comprises a liquid storage 17 and an organic carrier liquid 18 accommodated therein. For heating the liquid storage 17 and thus for evaporating the organic carrier liquid 18 with the components dissolved therein, such as nicotine, fragrances, and/or flavoring agents, the evaporator unit 15 comprises the electrically heatable heating element 16. Heating element 16 is supplied with power from electric energy storage 12 as controlled by control unit 13. By heating to an operating temperature of more than 100° C., the organic carrier liquid 18 accommodated in the liquid storage, in particular a high-boiling alcohol such as glycerol or propylene glycol, can be evaporated.

Figure 6:
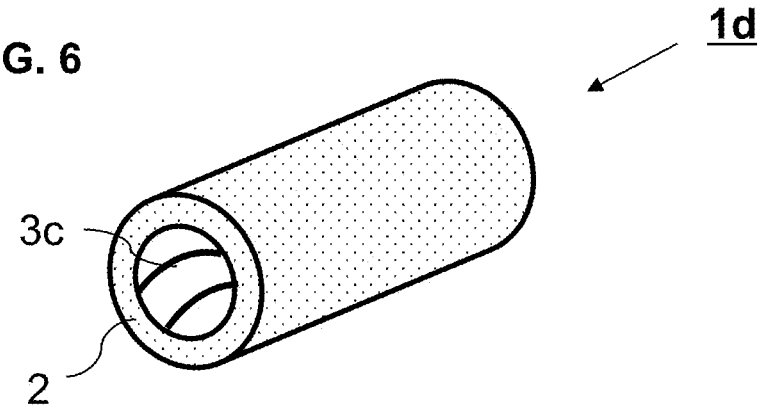
FIG. 6 schematically illustrates a further exemplary embodiment in which the heating conductor structures are on an internal surface thereof.

FIG. 6 schematically illustrates an exemplary embodiment of a heating element 1*d* according to the invention, in which the heating conductor structures 3*c* are located on an inner surface of the carrier material 2.

Figure 7A:
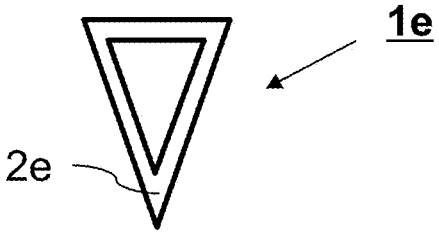
FIG. 7*a* schematically illustrates a further exemplary embodiment of a heating element according to the invention, in which the carrier material has a triangular shape.

FIG. 7*a* schematically illustrates an exemplary embodiment of a heating element 1*e* according to the invention, in which the carrier material 2*e* has a triangular design.

Figure 7B:
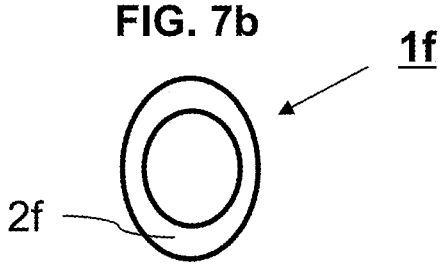
FIG. 7*b* schematically illustrates a further exemplary embodiment of a heating element according to the invention, in which the carrier material has an ellipsoid shape.

FIG. 7*b* schematically illustrates an exemplary embodiment of a heating element 1*f* according to the invention, in which the carrier material 2*f* has an ellipsoid design.

What is claimed is:

1. A heating element comprising:

at least one carrier material made of glass or glass ceramic, the carrier material having a thermal conductivity of less than 2 W/K*m, a thermal capacity of less than 1000 J/K*kg, and a roughness $R_a$ of less than 500 nm; and a metallic heating conductor structure on the carrier material.

2. The heating element of claim 1, wherein the heating element is configured for use in an electronic cigarette.

3. The heating element of claim 1, wherein the carrier material is a tube or a rod.

4. The heating element of claim 3, wherein the tube or rod has a diameter of less than 20 mm.

5. The heating element of claim 1, wherein the carrier material is a tube was a wall thickness of less than 5 mm.

6. The heating element of claim 1, wherein the carrier material is a glass tube with a polygonal cross-sectional shape.

7. The heating element of claim 6, wherein the polygonal cross-sectional shape is a triangle.

8. The heating element of claim 1, wherein the carrier material is a glass tube with a shape selected from the group consisting of a round cross-sectional shape, an ellipsoidal cross-sectional shape, and a hollow cross-sectional shape.

9. The heating element of claim 1, wherein the carrier material has a thickness of less than 2000 μm.

10. The heating element of claim 1, wherein the carrier material has a thickness of less than 50 μm.

11. The heating element of claim 1, wherein the carrier material has a thickness of not more than 500 μm.

12. The heating element of claim 1, wherein the carrier material comprises a thin glass capable of being rolled into a roll having a diameter of less than 20 mm.

13. The heating element of claim 1, wherein the carrier material is a material selected from the group consisting of a silicate glass, a borosilicate glass, an aluminum silicate glass, an aluminum borosilicate glass, a glass ceramic, an LAS glass ceramic, and an MAS glass ceramic.

14. The heating element of claim 1, wherein the carrier material is a glass comprising (in wt %):

| | |
|---|---|
| $Al_2O_3$ | 1 to 10; |
| $Na_2O$ | 1 to 10; |
| $K_2O$ | 0 to 5; and |
| CaO | 0 to 5. |

15. The heating element of claim 14, wherein the glass comprises CaO≥0.1.

16. The heating element of claim 1, wherein the carrier material is a chemically toughened glass having a product of thermal conductivity and specific heat capacity that is less than 1800 $J^2/K^2$*m*s*kg in a temperature interval from 20° C. to 100° C.

17. The heating element of claim 16, wherein the product is less than 1200 $J^2/K^2$*m*s*kg.

18. The heating element of claim 1, wherein the carrier material is a thin glass having edges that have been processed chemically and/or mechanically.

19. The heating element of claim 1, wherein the carrier material has a roughness of less than 250 nm.

20. The heating element of claim 1, wherein the heating conductor structure comprises an electrically conductive coating.

21. The heating element of claim 20, wherein the electrically conductive coating comprises a platinum-containing coating or an ITO-based coating.

22. The heating element of claim 1, wherein the heating conductor structure is on a surface of the carrier material in a helical or meandering shape.

23. The heating element of claim 1, wherein the heating conductor structure is on an entire surface of the carrier material.

24. The heating element of claim 1, wherein the heating conductor structure is on an outer lateral surface of the carrier material.

25. The heating element of claim 1, wherein the carrier material has a tubular shape and the heating conductor structure is on an inner lateral surface of the tubular shape.

* * * * *